US008973294B2

(12) United States Patent
Delgado Acarreta

(10) Patent No.: US 8,973,294 B2
(45) Date of Patent: Mar. 10, 2015

(54) CARTRIDGE COUNTER

(76) Inventor: Raúl Delgado Acarreta, Navarra (ES)

( * ) Notice: Subject to any disclaimer, the term of this patent is extended or adjusted under 35 U.S.C. 154(b) by 1390 days.

(21) Appl. No.: 11/883,410

(22) PCT Filed: Feb. 4, 2005

(86) PCT No.: PCT/ES2005/070012

§ 371 (c)(1),
(2), (4) Date: Mar. 4, 2008

(87) PCT Pub. No.: WO2006/084928

PCT Pub. Date: Aug. 17, 2006

(65) Prior Publication Data

US 2008/0276517 A1 Nov. 13, 2008

(51) Int. Cl.
*F41A 9/62* (2006.01)

(52) U.S. Cl.
CPC ..... *F41A 9/62* (2013.01)
USPC ..... 42/1.02

(58) Field of Classification Search
USPC ..... 42/1.02, 1.01
See application file for complete search history.

(56) References Cited

U.S. PATENT DOCUMENTS

| | | | | |
|---|---|---|---|---|
| 3,993,946 | A * | 11/1976 | Makino | 324/207.21 |
| 4,810,965 | A * | 3/1989 | Fujiwara et al. | 324/207.22 |
| 5,052,138 | A | 10/1991 | Crain | |
| 5,142,805 | A | 9/1992 | Horne et al. | |
| 5,303,495 | A | 4/1994 | Harthcock | |
| 5,799,432 | A * | 9/1998 | Wright et al. | 42/1.02 |
| 5,826,360 | A | 10/1998 | Herold et al. | |
| 6,094,850 | A | 8/2000 | Villani | |
| 7,329,127 | B2 * | 2/2008 | Kendir et al. | 434/21 |
| 8,601,733 | B2 * | 12/2013 | Gabay et al. | 42/1.02 |

FOREIGN PATENT DOCUMENTS

WO 2004/051176 6/2004

* cited by examiner

*Primary Examiner* — Reginald Tillman, Jr.
(74) *Attorney, Agent, or Firm* — Blank Rome LLP

(57) ABSTRACT

Box type ammunition clip that can be totally or partially fitted to an automatic and/or semiautomatic firearm 11, including a distance detection mechanism 25 that measures the distance between the ammunition push tile 22 and the base 28 of the rounds 21 clip 29.

10 Claims, 8 Drawing Sheets

CARTRIDGE COUNTER

PURPOSE OF THE INVENTION

This invention refers in general to an ammunition clip that can be fitted in an automatic and/or semiautomatic breech-loading firearm.

STATUS OF THE TECHNIQUE

Currently, the perfectioning of automatic and/or semiautomatic breech-loading firearms has increased the rounds storage capacity of clips; for example a semiautomatic pistol can store more than twelve rounds in a clip.

In this type automatic and semiautomatic firearms, the task of counting the number of rounds still left in the clip loaded in the firearm is a burdensome, difficult and tiresome task that can be even more complicated when the user handling it is under pressure for his own life.

Therefore there is a need to develop a system that can count the rounds still left in the clip fitted to the automatic or semiautomatic breech-loading firearm. Furthermore, the round counter system shows the number of rounds left in the clip on a display located on the firearm casing or body.

CHARACTERIZATION OF THE INVENTION

This invention seeks to resolve or reduce one or more of the inconveniences exposed above using an ammunition clip for automatic and/or semiautomatic firearm such as in claim 1. Executions of the invention are established in the dependent claims.

The ammunition clip includes a frame on the inside that contains an ammunition push mechanism that is displaced by a first spring between the base on one end of the frame and a second end of the frame, entry/exit hole for ammunition rounds; the clip includes a distance detection means that measures the distance between the push tile and the base of the clip.

The distance is sent to a programmable logic means that depending on the distance received determines the number of ammunition rounds stored in the clip fitted to the firearm. As a result, a shooter can tell at any time how many rounds are stored in the clip fitted to the firearm.

Another purpose of the invention is to count the amount of ammunition consumed by the firearm in order to determine the useful life remaining of the firearm parts thereof.

Another purpose of the invention is to ensure the visibility of the items selected and displayed on a display screen by the shooter when making use of the gun.

Another purpose of the invention is to provide a partial count of shots made with a given clip.

Another goal of the invention is to provide a counter of ammunition rounds stored in a clip loaded in a small size automatic and/or semiautomatic firearm that is lightweight and cheap.

BRIEF DESCRIPTION OF THE FIGURES

A more detailed explanation of the invention is provided in the following description to based on the figures attached that.

DESCRIPTION OF THE INVENTION

Figure 1:
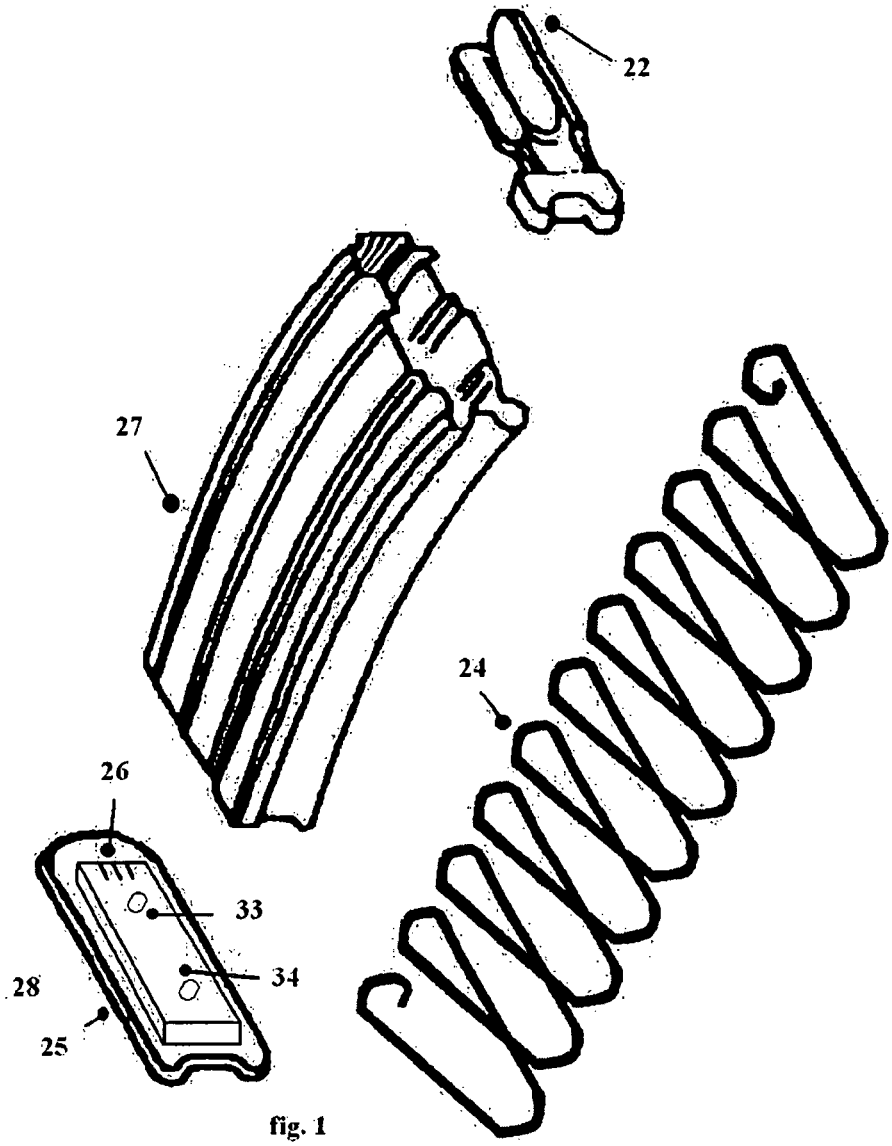
FIG. 1 shows an expanded perspective view of a clip in accordance with the invention.

Below, in reference to FIG. 1, is a pieced clip 29 of rounds 21 or box type container for an automatic and/or semiautomatic breech-loading firearm 11, which stores a variety of rounds 21 piled one on top of the other 21.

Figure 2:
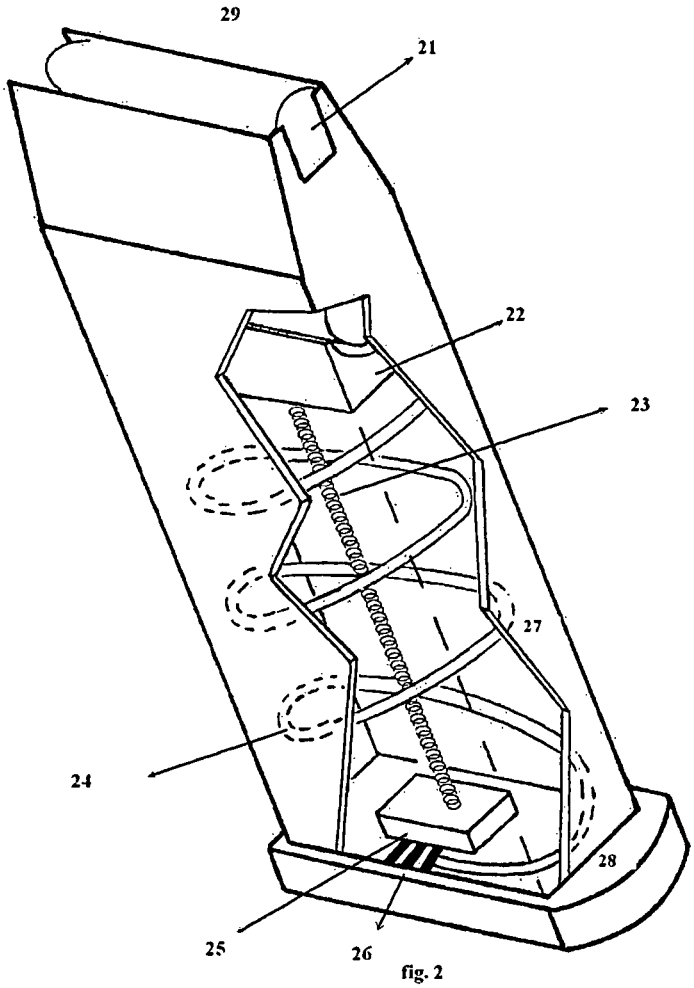
FIG. 2 shows a section perspective view of a clip in accordance with the invention.
Figure 3:
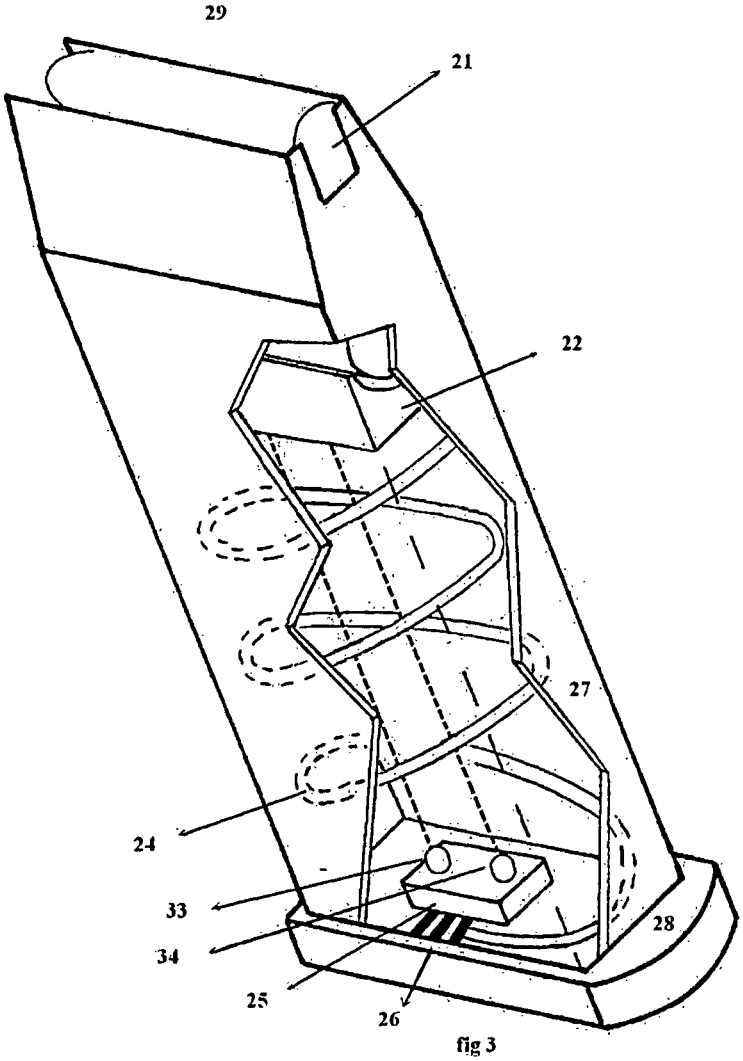
FIG. 3 shows another section perspective view of a clip in accordance with the invention.

Now with regards to FIGS. 1, 2 and 3, the clip 29 includes a hollow cross section polygonal frame or shell 27, substantially rectangular, suitable for the dimensions of the rounds 21 that will be stored in the clip 29.

The near end of the clip 29 fitted into an automatic and/or semiautomatic breech-loading firearm 11 includes an entry/exit hole for round 21 of clip 29 access aperture; i.e.: fitting hole located in the upper part of the clip 29 when it is supported at the opposite end in a substantially vertical position.

The other end, opposite to the clip 29 access hole, is closed by a surface or base 28 of the clip 29 that closes it and serves and the seating or support to a first push spring 24, of the clip 29, that moves an ammunition push means 22 longitudinally such as a tile between the empty clip 29 position, the spring is unstressed and full clip 29, the first spring 24 is compressed.

Consequently, the rounds 21 stored in the clip 29 are moved towards to the clip 29 entry each time a round 21 is expelled out of the clip 29, or towards the base 28 each time a round 21 is added through the clip 29 access hole.

As a result of the push effort made by the first spring 24, the tile 22 moves upward or downward depending on if a round 21 is extracted or introduced in the clip 29 respectively.

A distance detection means 25 measures the distance between the tile 22 and the base 28. The distance perceiver 25 is located in a place configured for such purpose between the tile 22 and the base 28 of the clip 29. So that when the tile 22 moves longitudinally, the distance perceiver 25 generates an electric signal that indicates the longitudinal movement made by the tile 22, either upward towards to the access or downward towards the base 28 of the rounds 21 clip 29.

Figure 4:
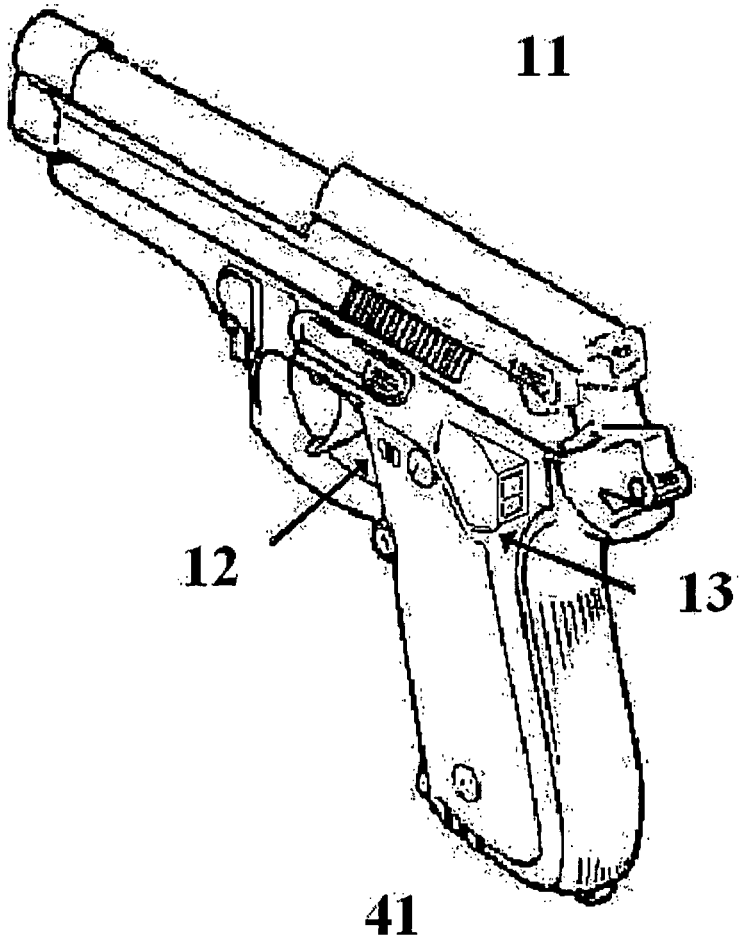
FIG. 4 shows an expanded perspective view of a pistol firearm in accordance with the invention.
Figure 7:
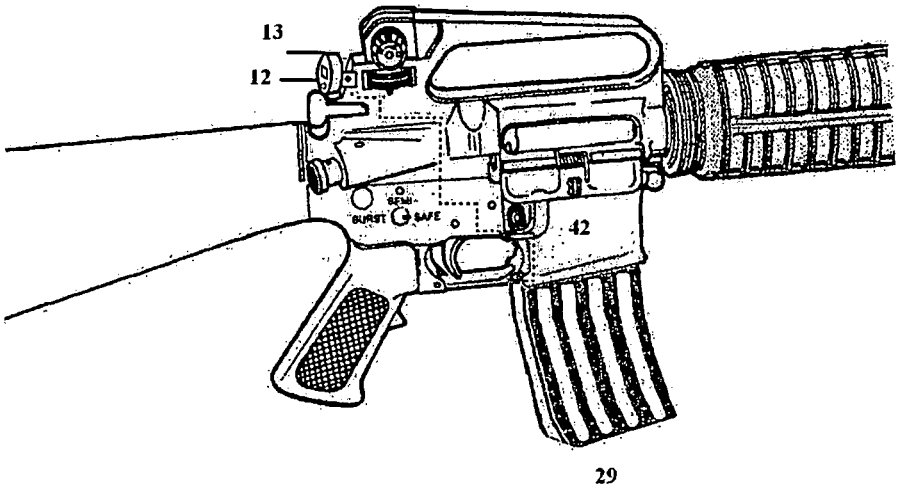
FIG. 7 shows a perspective view of an automatic and/or semiautomatic breech-loading firearm with the clip in accordance with the invention.
Figure 8:
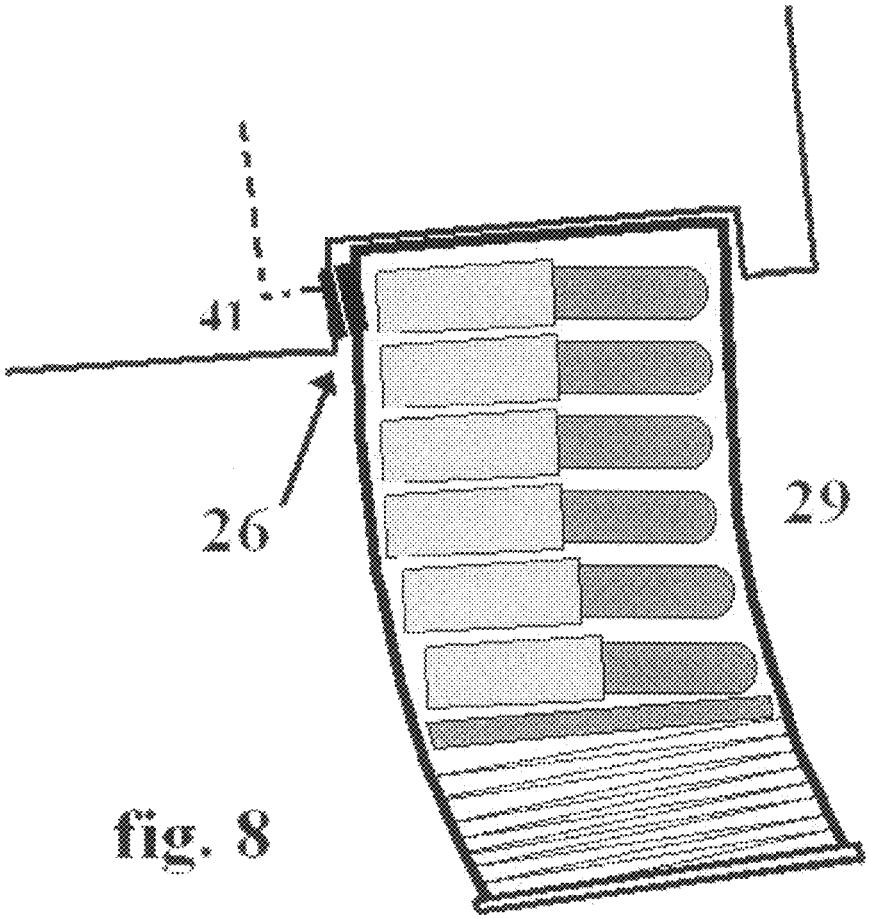
FIG. 8 shows an elevation view of the clip fitted into the automatic and/or semiautomatic breech-loading firearm in accordance with the invention.

The distance perceiver 25 includes a first set of electric terminals 26 adapted to make electric contact with a second set of electric terminals 41 located at the tip 42 of the firearm 11, see FIGS. 4, 7 and 8. Obviously, both sets 26, 41 or terminals are facing when the clip 29 is loaded in the tip 42 of the firearm 11.

The first set 26 of electric terminals can be placed, for example, at the entrance of the clip 29 fitting location in the case of partially fitted clip 29 (sub rifle, assault rifle, lightweight machine gun, etc.), displayed in FIGS. 7 and 8; or in the other end of the clip 29 casing 27 when totally fitted inside the handle of a firearm 11 such as pistol, displayed in FIG. 4. The location of the two sets 26, 41 of terminals shall be such that they provide a robust electrical connection that is practical and maintenance free, ideal for tough usage of the firearm 11 in aggressive environments, i.e.: in the open air.

The number of electrical terminals required may vary depending if the clip 29 shell 27 is made of steel and if such steel shell 27 is used as mass for the electric circuit that is part of the rounds 21 counting system. In this case, the number of terminals required for each set 26, 41 shall be less than when the clip 29 casing 27 is not used as mass for the electric circuit.

Figure 5:
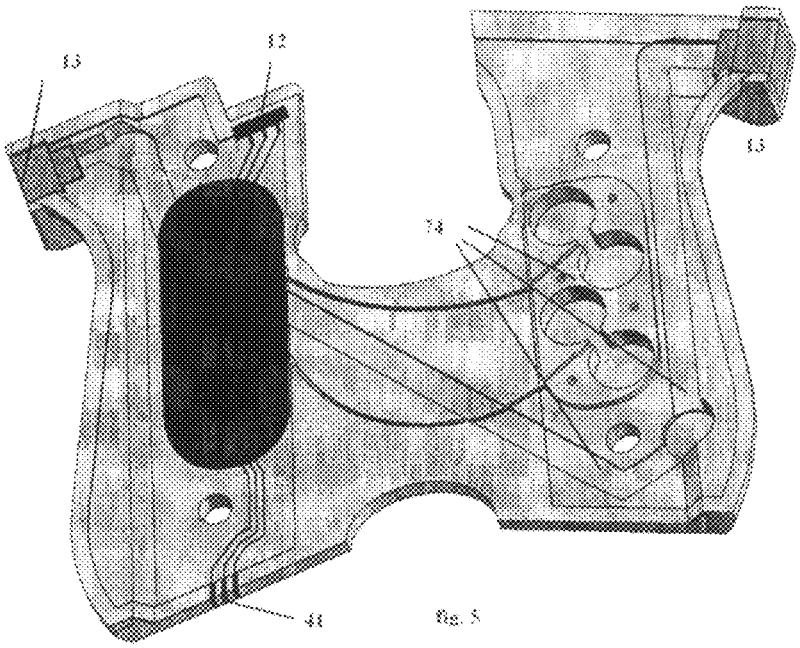
FIG. 5 shows a perspective view of the inside of firearm handle covers in accordance with the invention.
Figure 6:
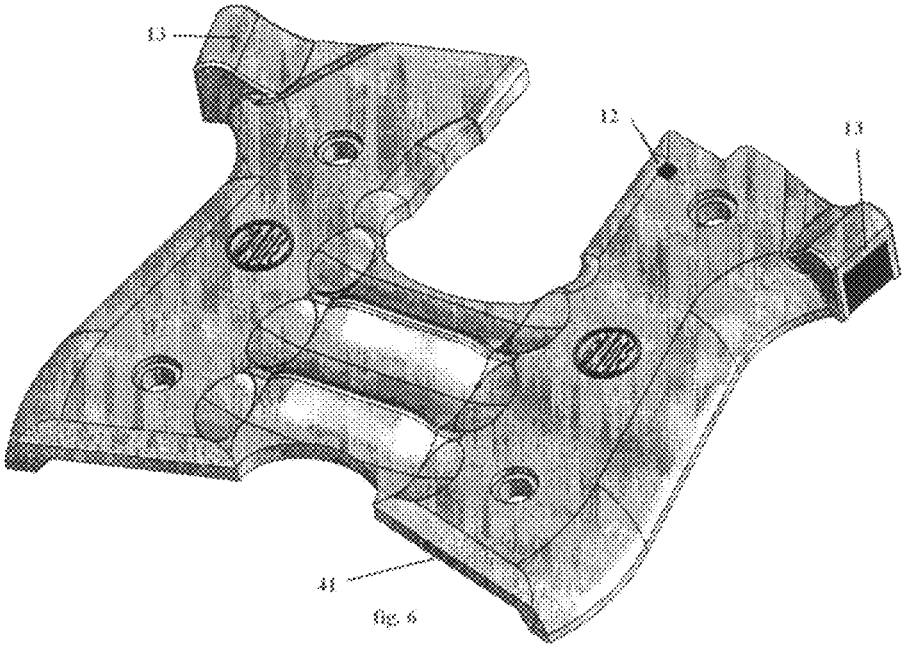
FIG. 6 shows a perspective view of the outside of firearm handle covers in accordance with the invention.

With regards to FIG. 5, the second 26 set of contacts, in turn, is connected to a programmable logic means, microprocessor, that can count the rounds 21 stored in the clip 29 based on the signals received from the distance perceiver 25.

The microprocessor 71 is located in a location provided for such purpose in the firearm 11 handle between the handle frame and the covers 73.

When the clip 29 is fitted in the firearm 11, both first 26 and second 41 of electrical terminals are in electrical contact and allow an electric signal, relative to the movement of the push tile 22, to be sent from the distance perceiver 25 through both sets 26, 41 of contacts and electric connections to the microprocessor 71 that, in turn, are also connected via electrical 6 connections to a display 13, located in the body or casing of the firearm as such and in sight of the shooter when pointing the firearm 11 to a potential target. For example, the display 13 can be located near the firearm 11 sights and, therefore, within the visual sights of the shooter, displayed 4, 5, 6 and 7.

The location of the display 13 in the casing of the firearm 11 shall be such that the information displayed on the display 13 can be read by the shooter in a variety of positions between the firearm 11 and shooter.

When the microprocessor 71 receives an electric signal from the distance perceiver 25, it will increase by one the total number of shots made by said firearm 11 and in turn reduces by one the number of rounds 21 stored in the clip 29. The result of both counts can be displayed on the display 13; by default it shall display the amount of rounds 21 currently stored in the clip 29, but it shall be possible to view the total number of shots made by the firearm 11.

In summary, the total counter functions counts the total amount of ammunition consumed by the firearm 11 during its usage, and the partial counter function appears immediately on loading a clip 29 in the firearm 11. Once the clip 29 is loaded, the display 13 will show the number of rounds 21 stored in it, which shall be any number between zero, empty clip 29, and the maximum number of rounds 21 that can be stored in the clip 29. The number of the rounds 21 to be controlled shall be solely limited by the size of the clip 29, as there are no restrictions in terms of the counter.

It should be noted that the rounds 21 clips for automatic and semiautomatic breech-loading firearms 11 are normalized; therefore, the microprocessor 71 shall be capable of calculating, once a clip 29 has been fitted, the total number of rounds 21 currently stored in the clip 29 fitted in firearm 11 based on the signals received from the distance perceiver 25. Given that a clip 29 is not always fitted in a firearm 11, such clip 29 must store the maximum number of rounds 21 that it can store, situation of full clip 29.

Returning to FIGS. 1, 2 and 3, the distance perceiver 25 is connected to the tile 22 through a connection interface means 23 such as a second 23 spring; i.e.: finely calibrated spirals, so that its near end is connected to the distance perceiver 25 and the other end is connected to the lower part of the push tile 22. The distance perceiver 25 receives from the second 23 spring a signal that is the result of extending the second 23 spring. The signal received varies between a value that corresponds with the maximum number of rounds 21 that can be stored in a clip 29 and a value that corresponds to the minimum number of rounds 21 stored in the clip 29.

The signal received by the distance perceiver 25 is converted into an electric signal that is sent to the microprocessor 71, which transforms it into a counter unit visible on the display 13.

The mechanical tension of the second 23 spring, in its maximum distressed position, is very small and does not interfere with the push function made by the first 24 spring.

Similarly, the connection provided by the interface means 23 can be performed with an infrared beam; i.e.: the variation of tile 22 position is calculated using an infrared light emitting diode 33 that emits an infrared signal reflected by the underside of the tile 22, and received in a receiving diode 34; both diodes 33, 34 are connected to the distance perceiver 25. Consequently, the signal received by the distance perceiver 25 from the receiving diode 34 is the result of the distance between tile 22 and the clip 29 base 28. Similarly, the signal received varies between a value that corresponds with the maximum number of rounds 21 that can be stored in the clip 29 and a value that corresponds with the minimum number of rounds 21 stored in the clip 29.

The tile 22 includes a reflecting surface on the underside, suitable to reflect an infrared light beam. Both the projected and reflected beam travel through an empty space between the spirals of the first 24 spring and no elements external to the system interfering in their course. The distance perceiver 25 transforms the signal received into an electric signal that is sent to the microprocessor 71 that turns it into a visible counter unit.

In another execution, the distance perceiver 25 can include a variable linear magnetoresistance and a permanent magnet secured to the ammunition push tile 22, so that the value of the magnetoresistance shall vary depending on the distance of movement of the permanent magnet.

Another execution of the distance perceiver 25 can include a series of ultrasounds emitters-receivers, so that when the tile 22 moves, it generates a variation in the internal volume of the clip 29 between the tile 22 and base 28.

The microprocessor 71 can be connected to a data input/output interface, not displayed, that includes an alphanumeric keyboard and functions such as vertical movement up and down, which can be used to perform data input and output to and from the microprocessor 71. Furthermore, some keys can be associated to certain characters and/or functions.

The keyboard can change, in manual mode, from one information displayed on the screen and another easily and quickly; i.e.: if the initial option was to display the number of shots corresponding to the clip 29 fitted in the firearm 11 at a given time, pressing the corresponding button can display the total number of shots made with the firearm 11.

Returning now to FIGS. 4, 5 and 7, the firearm 11 fitted with the clip 29 of this invention, includes an on/off switch 12 so that the microprocessor 71 does not perform certain functions and/or no information is displayed in the display 13. For example, when the firearm 11 is not going to be used or when the shooters empties a clip 29 of rounds 21 without removing the clip 29 from the firearm 11, not consuming energy from a power source, a battery or similar.

The display 13 of the firearm 11 can show information selected by the shooter from the possible information that can be provided by the microprocessor 71 such as the total number of shots taken, number of rounds stored in the clip 29 currently fitted in the firearm 11 or other similar information. The firearm 11 shooter only has to select the type of information to be displayed on screen through the keyboard.

As already indicated, the display 13 can be placed on top of the firearm 11, on one side, for example, on the opposite side of the expulsion hole, so that the display 13 can be viewed at all times by the shooter when taking a shot, i.e.: the display 13 shall be facing the shooter.

Furthermore, display 13 can be moved on the axis of the firearm 11 barrel; i.e.: not being vertical to the barrel so that the display 13 is substantially moved from an imaginary line that connects the slights of the firearm 11, enabling the user to use the firearm 11 sights when shooting.

The entire counter system is powered with electricity from the power source that feeds all the rounds 21 counter system circuits. The battery is connected to the perceiver 25, display 13 and microprocessor 71 through electrical connections; the battery is of reduced size and long duration such as a Lithium battery that are long lasting. The battery is located in position 74 provided for such purpose between a cover 73 of the handle and the casing of the handle, for example, displayed in FIG. 5.

The battery can be rechargeable or throw-away. If rechargeable, it shall include contacts for such purpose at the connector that connects the alphanumeric keyboard, for example.

In order to extend the useful life of the battery as much as possible, the counter system shall be powered on/off with a switch 12 provided for such purpose, so that when the firearm 11 is not being used, the switch 12 shall be in the off position and, when the gun 11 will be used, the switch 12 is in the on position. In the event the switch is off, the microprocessor 71 shall continue to receive power in order to maintain certain information stored such as the total number of shots made with the firearm 11.

The display 13 can be either LCD, electroluminescent, plasma or similar, because these technologies involve less consumption of electricity. Furthermore, the screen 13 can be touch sensitive, therefore, some data input functions could be performed through the screen 13.

The executions and examples established in this report are presented as the best explanation of this invention and its practical application in order to allow experts on this matter to put the invention into practice and use it. However, the experts on this technique will realize that the description and examples above have been presented for illustrative purposes only as an example. The description provided is not destined to be comprehensive or limit the invention to the precise form described. Many modifications are variations are possible in light of the above without excluding the spirit and scope of the following claims.

The invention claimed is:

1. An ammunition clip for an automatic and/or semiautomatic firearm, the ammunition clip comprising:

a rounds counter;

a frame with an ammunition push mechanism housed inside the frame;

wherein the ammunition push mechanism is movable by a first spring between a base at one end of the frame and an entry/exit hole for ammunition rounds at another end of the frame;

wherein the rounds counter includes distance detection means that measures a distance between the ammunition push mechanism and the base of the frame;

wherein the distance detection means includes a variable linear magnetoresistance element and a movable permanent magnet secured to the ammunition push mechanism so that a distance between the ammunition push tile and the base is calculated by a magnetoresistance; and wherein the variable linear magnetoresistance is located in the firearm handle.

2. A clip in accordance with claim 1; wherein the magnetoresistance element is a magnetic transducer.

3. A clip in accordance with claim 2; wherein the magnetic transducer is analog.

4. A clip in accordance with claim 3; wherein the clip is made of a paramagnetic material.

5. A clip in accordance with claim 3; wherein the frame includes a rectangular slot facing the magnetic transducer.

6. A clip in accordance with claim 1, wherein the clip includes a first set of electrical terminals located outside a clip casing.

7. A clip in accordance with claim 6, wherein the clip first set of electrical terminals is located near the entry/exit hole of the frame.

8. A clip in accordance with claim 6, wherein the first set of electrical terminals is located at the base of the frame.

9. A clip in accordance with claim 1, wherein the clip is of a box type.

10. An ammunition clip for a firearm, the ammunition clip comprising:

a frame having an open end through which rounds are loaded and unloaded, and a base;

an ammunition push mechanism housed inside the frame;

the ammunition push mechanism including:

an ammunition push tile movable between a first position near the open end of the frame and a second position near the base of the frame;

a movable permanent magnet secured to the ammunition push tile to move with the ammunition push tile between the first position and the second position to produce a variable linear magnetoresistance; and a spring between the base of the frame and the ammunition push tile to bias the ammunition push tile toward the first position;

and distance detection means that measures a distance between the ammunition push tile and the base of the frame by measuring the variable linear magnetoresistance produced by the permanent magnet.

* * * * *